US005553430A

United States Patent [19]

Majnaric et al.

[11] Patent Number: 5,553,430

[45] Date of Patent: Sep. 10, 1996

[54] METHOD AND APPARATUS FOR ERECTING BUILDING STRUCTURES

[75] Inventors: Anton B. Majnaric, Copley; William M. Bjerke, Hudson, both of Ohio

[73] Assignee: Majnaric Technologies, Inc., Copley, Ohio

[21] Appl. No.: 293,038

[22] Filed: Aug. 19, 1994

[51] Int. Cl.[6] ..... E04B 2/00; E04B 5/00

[52] U.S. Cl. ..... 52/236.8; 52/91.2; 52/320; 52/322; 52/323; 52/425; 52/426; 52/428

[58] Field of Search ..... 52/319, 425, 426, 52/320, 323, 236.8, 91.2, 322, 428

[56] References Cited

U.S. PATENT DOCUMENTS

| | | | |
|---|---|---|---|
| 510,720 | 12/1893 | Stewart, Jr. | 52/426 X |
| 1,124,404 | 1/1915 | Featherstone | 52/91.2 X |
| 1,345,156 | 6/1920 | Flynn | 52/426 X |
| 1,598,145 | 8/1926 | Lozano | 52/322 X |
| 1,729,612 | 10/1929 | Goldsmith | 52/320 |
| 1,987,115 | 1/1935 | Kotrbaty | 52/236.8 |
| 1,990,654 | 2/1935 | Kotrbaty | 52/323 X |
| 2,154,390 | 4/1939 | Akers | 52/320 X |
| 3,613,325 | 10/1971 | Yee | 52/236.8 |
| 4,461,130 | 7/1984 | Shubow | 52/236.8 |
| 4,594,828 | 6/1986 | Taylor | 52/713 X |
| 4,841,707 | 6/1989 | Novoa | 52/426 |
| 4,862,660 | 9/1989 | Raymond | 52/426 X |
| 5,065,561 | 11/1991 | Mason | 52/426 X |
| 5,117,600 | 6/1992 | Yerushalmi | 52/426 X |
| 5,274,975 | 1/1994 | Haag | 52/238.1 X |
| 5,311,718 | 5/1994 | Trousilek | 52/425 |
| 5,402,612 | 4/1995 | diGirolamo et al. | 52/241 |

FOREIGN PATENT DOCUMENTS

| | | | |
|---|---|---|---|
| 2558868 | 8/1985 | France | 52/426 |
| 461086 | 4/1951 | Italy | 52/320 |
| WO88/02803 | 4/1988 | WIPO | 52/236.8 |

*Primary Examiner*—Carl D. Friedman
*Assistant Examiner*—Laura A. Saladino
*Attorney, Agent, or Firm*—Renner, Kenner, Greive, Bobak, Taylor & Weber

[57] ABSTRACT

A method and apparatus for erecting building structures is presented. A plurality of wall panels are interconnected with each other in an array by column connectors interposed therebetween. Wall caps are then placed upon top surface portions of the wall panels and column connectors. Floor panels are then joined to the wall caps, with the floor panel forms having cavities to form headers over supporting wall panels and purlins between supporting wall panels. Rebar is placed into selected wall panels, purlins, and headers. Concrete is then deposited into selected ones of the wall panels and over the floor forms, filling the purlin and header cavities. Subsequently, a new array of wall panels and column connectors is erected on top of the poured concrete and the process is repeated to erect subsequent stories of the building.

19 Claims, 14 Drawing Sheets

METHOD AND APPARATUS FOR ERECTING BUILDING STRUCTURES

TECHNICAL FIELD

The invention herein resides in the art of building structures and, more particularly, to such structures which employ forms for the fabrication of such buildings from concrete in situ. Specifically, the invention relates to an apparatus and technique by which a plurality of panel and column assemblies are interconnected and subsequently filled with concrete and wherein the panel skins are allowed to remain upon final cure of the concrete and insulation, such panel skins providing the finished surface of portions of the erected structure.

BACKGROUND ART

It has previously been known to erect buildings on-site by means of custom fabrication. However, such techniques have been found to be time consuming and costly. Such custom building techniques and apparatus have given way to prefabrication which, in general, has required the fabrication off-site of prefabricated wall and floor panels which are subsequently interconnected on-site to erect the structural framework and the like. While the techniques and apparatus employed in these prefabrication practices have generally reduced the time and cost incident to the erection of a building, further improvements in such reduction are desired. Additionally, such known techniques and apparatus have generally not taught that the panel members employed for forming the prefabricated subassemblies may remain as finished surfaces of the final assembly.

The prior art has been substantially devoid of techniques and apparatus by which structural forms may be erected on-site and subsequently filled with concrete or other setting material for development of the structure substantially totally on-site.

DISCLOSURE OF INVENTION

In light of the foregoing, it is a first aspect of the invention to provide a method and apparatus for erecting building structures in which a plurality of building panels may be interconnected on-site and subsequently filled with concrete or the like in-situ.

Another aspect of the invention is to provide a method and apparatus for erecting building structures in which the structural panels includes skins which confine the concrete during pour, and which also serve as the finished surfaces of the building.

Yet another aspect of the invention is to provide a method and apparatus for erecting building structures which accommodates a continuous pour of concrete on-site.

Still an additional aspect of the invention is the provision of a method and apparatus for erecting building structures in which a minimum of panel and column assemblies are required for effecting any of a wide variety of building structures.

It is yet another aspect of the invention to provide a method and apparatus for erecting building structures which is easily implemented with state of the art materials and manufacturing procedures.

The foregoing and other aspect of the invention which will become apparent as the detailed description proceeds are achieved by a building structure, comprising: a first plurality of wall panels; a second plurality of column connectors interposed between and among selected ones of said wall panels and interconnecting said selected ones of said wall panels; a third plurality of wall caps extending over top surfaces of said wall panels and column connectors; and a fourth plurality of floor form assemblies received by and extending from said wall caps.

Other aspects of the invention are attained by a method for erecting a building, comprising: (a) interconnecting a plurality of wall panels to each other through a plurality of column connectors; (b) placing wall caps upon top surface portions of said interconnected wall panels and column connectors; (c) connecting floor panel forms to said wall caps, said floor panel forms having cavities for forming headers over supporting wall panels and purlins between said supporting wall panels; (d) filling selected ones of said wall panels with concrete, filling said purlin and header cavities with said concrete, and covering a top surface of said floor panel forms to a predetermined level with concrete, thereby defining a first story of the building; and (e) repeating steps (a–d) to define each desired subsequent floor.

DESCRIPTION OF DRAWINGS

For a complete understanding of the objects, techniques, and structure of the invention reference should be made to the following detailed description and accompanying drawings wherein.

BEST MODE FOR CARRYING OUT THE INVENTION

Figure 1:
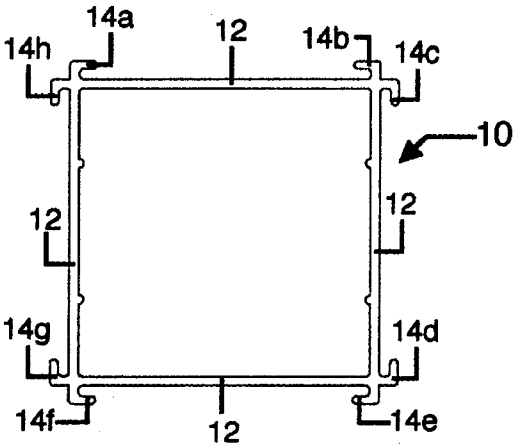
FIG. 1 is a cross sectional view of a standard column connector according to the invention in a square configuration.

For an understanding of the invention, an appreciation of the various components employed in the fabrication of a building made in accordance with the invention should first be attained. Accordingly, reference is now made to certain of the drawings in which various of the building components are illustrated. It will be appreciated by those skilled in the art that those elements and features shown in the drawings are illustrative only in that numerous and various modifications and/or changes may be employed to fit particular needs.

Referring now to the drawings and more particularly FIG. 1, it can be seen that a column connector in accordance with the invention is designated generally by the numeral 10. As with most of the panel and column members of the invention, the column connector 10 is preferably constructed of a synthetic material such as polyvinylchloride (PVC) or other suitable reinforced polymeric material. It will be appreciated that the column connector 10 is an elongated member, shown in cross section only in FIG. 1. As illustrated, the column connector 10 has a square cross section, consisting of equal side plates 12. A plurality of channel member 14*a*–14*h* extend laterally along the corners of the intersections of the side plates 12. Depending upon the position in the building structure at which the column connector 10 is to be employed, certain channel members 14*a*–14*h* may be removed, either in situ, or during the process of fabricating the column connectors themselves. To minimize the number of molds required for making the various column connectors 10, a standard column connector such as shown in FIG. 1 may be manufacture and the undesired channel members 14*a*–14*h* simply be removed prior to installation. Of course, various column connectors 10 may be molded, if desired, having only the desired channel members 14*a*–14*h*. Presently, it is contemplated that selected ones of the channel members 14*a*–14*h* may be removed during the manufacturing process of the die face, while in a heated state and prior to entry into the sizer. However, any of various techniques may be employed.

As the description proceeds, it will be appreciated that a column connector used at an end may necessarily only require channel members 14*a* and 14*b*. A straight column connector may require only channel members 14*c*, 14*d*, 14*g*, and 14*h*. A corner column connector may be formed and/or modified to include channel members 14*a*, 14*b*, 14*c*, 14*g*, and 14*h*. In accordance with another embodiment, channel member 14*a*–14*d*, 14*g*, and 14*h* may be employed for implementation at a T intersection.

Figure 2:
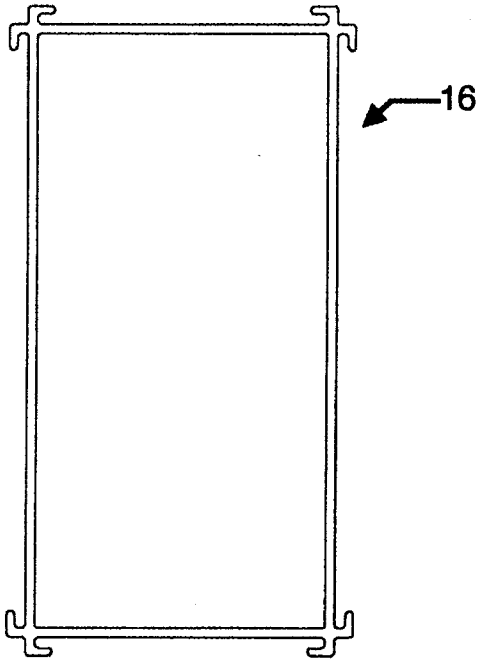
FIG. 2 is a cross sectional view of a standard column connector according to the invention in a rectangular configuration.

As shown in cross section in FIG. 2, column connectors 16 may also be provided in rectangular cross section, the same again having four interconnecting side plates with appropriate channel members as just discussed with respect to the square column connector 10. Of course, the physical size and configuration of the column connectors 10–16 will be determined by the size of the wall panels employed in the structure as will be apparent hereinafter.

Figure 3:
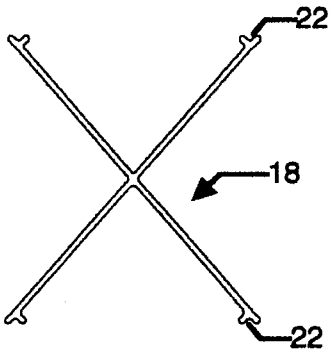
FIG. 3 is an cross sectional view of a typical panel spacer employed by the invention in a "X" configuration.
Figure 4:
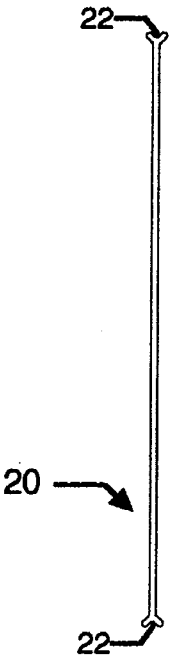
FIG. 4 is cross sectional view of a typical panel spacer employer by the invention in a "Y" configuration.
Figure 4A:
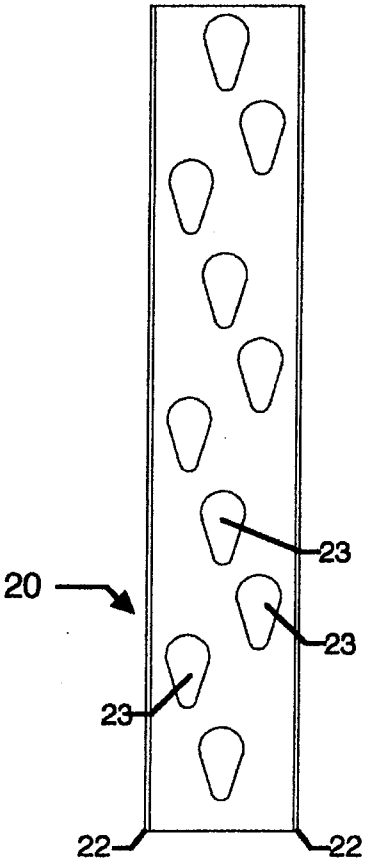
FIG. 4A is a front elevational view of the spacer of FIG. 4, showing the rebar receiving slots therein.

With reference now to FIGS. 3 and 4, an appreciation of the spacer member employed between the skins of the floor and wall panel of the invention can be seen. FIG. 3 presents a cross sectional view of a panel skin spacer 18 in an "X" configuration, while FIG. 4 presents a panel skin spacer 20 of a linear nature, referred to as a "Y" configuration. As illustrated in the drawings, each of the spacers 18, 20 is provided with a locking member 22 at each of the ends thereof. The locking members 22 are typically V-shaped and adapted for receipt by locking receptacles in the panel skins as will be discussed below. Those skilled in the art will appreciate that the spacers 18, 20 comprise elongated members, being shown only in cross section in FIGS. 3 and 4. In a preferred embodiment of the invention, the panel skin spacers may be provided with slots for receiving and supporting concrete poured therebetween. As illustrated in FIG. 4A, the spacer 20 may be characterized by a plurality of inverted teardrop shaped slots 23 therein for receiving rebar. With several such spacers 20 in alignment between a pair of panel skins, rebar may be passed through selected ones of aligned slots 23 prior to the entry of concrete into the cavity between the skins. The tear drop shape of the slots 23 assures that the rebar will seat itself within the slots.

Figure 5:
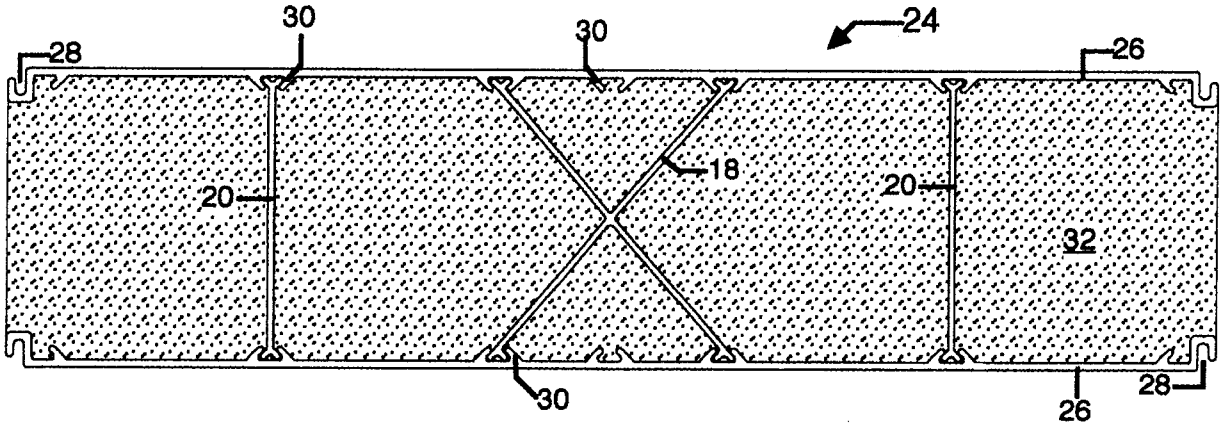
FIG. 5 is a cross sectional view of a wall panel assembly according to the invention.

A wall panel assembly 24 made in accordance with the invention is shown in cross section in FIG. 5. As illustrated, the panel assembly 24 comprises a pair of spaced apart panel skins 26, again made of synthetic material such a PVC or the like. Each of the ends of the panel skins 26 is provided with channel-shaped connectors 28 extending along the edges thereof. The interior of each of the skins 26 is provided with a plurality of generally triangular shaped locking receptacles 30 which are adapted to slidingly receive the locking member 22 at the ends of the spacer members 18, 20. Accordingly interengagement of the locking members 22 and locking receptacles 30 secure the spacers 18, 20 to the panel skins 26, maintaining the skins 26 in fixed spaced apart relationship to each other, thereby defining the panel assembly 24. As will become apparent below, an appropriate filler 32 such as concrete or the like is typically placed between the panel skins 28 in situ to provide the structural integrity desired.

Figure 6:
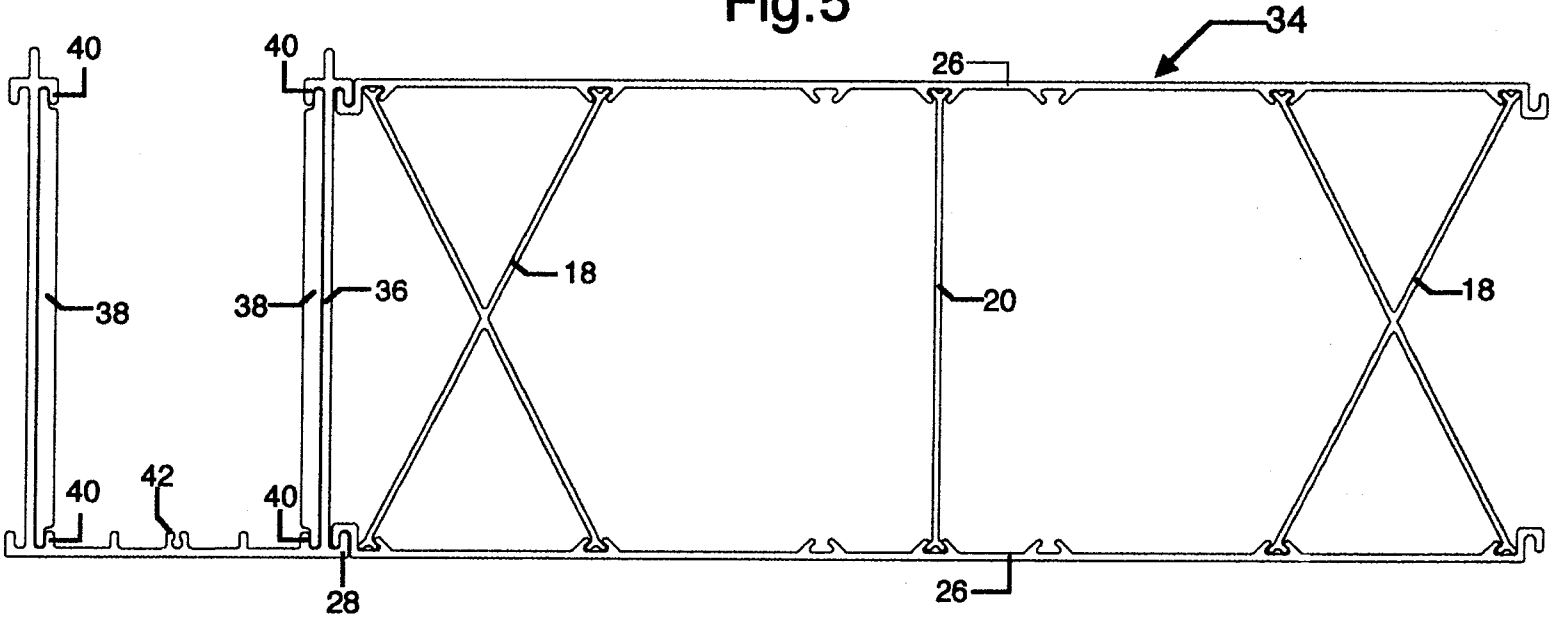
FIG. 6 is a cross sectional view of a floor panel assembly according to the invention.

In FIG. 6, a cross sectional view of a floor panel assembly made in accordance with the invention is also shown and designated by the numeral 34. The floor form assembly 34 comprises spaced-apart panel skins 26 within interconnecting spacers 18, 20, as shown. The connectors 28 at one end of each of the panels 26 of FIG. 6 is shown to be interconnected with a purlin form 36. As illustrated, sliding engagement of the channel connectors 28 allows for the interengagement of the purlin form 36 with the floor panel assembly 34. Where required, purlin stiffeners 38 may also be slid into place along the sides of the side plates of the purlin form 36 and maintained in such position by means of retainers 40. A rebar clip 42 may also be provided as shown.

Figure 8:
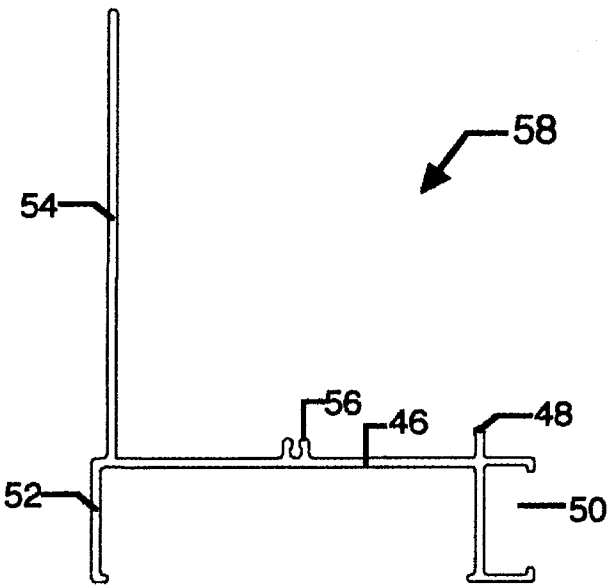
FIG. 8 is a cross sectional view of another embodiment of a typical aligning wall cap according to the invention.
Figure 7:
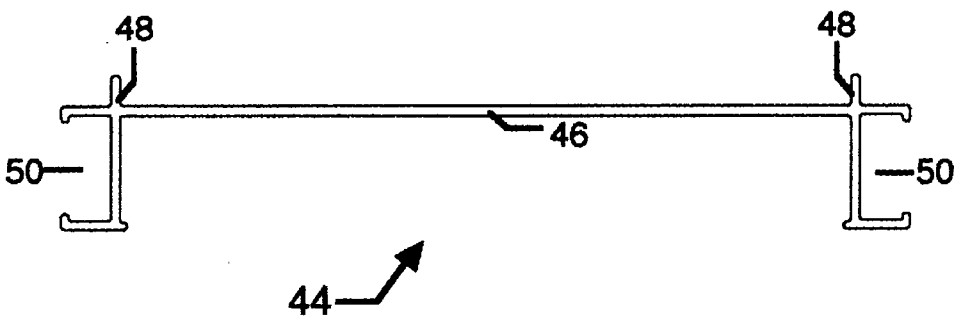
FIG. 7 is cross sectional view of a first typical embodiment of an aligning wall cap employed by the invention.

It will be appreciated that the wall panel 24 must necessarily receive caps at areas of interface with other panel members or the like. While the specific designs and configurations of such wall caps may vary to suit intended purposes and needs, representative wall caps according to the invention are shown in FIGS. 7 and 8. In FIG. 7, an aligning wall cap 44 includes a top plate 46, top ribs 48, and side channel members 50. The aligning wall cap 58 shown in FIG. 8 includes a top plate 46, extending top rib 48, a side channel member 50, a lower side plate 52, an upper side plate 54, and a rebar clip 56. Implementation of the wall caps 44, 58 will be shown in subsequent drawings and described further herein. Similarly, various modifications to such wall caps and the presence of other configurations thereof will further become apparent.

Figure 9:
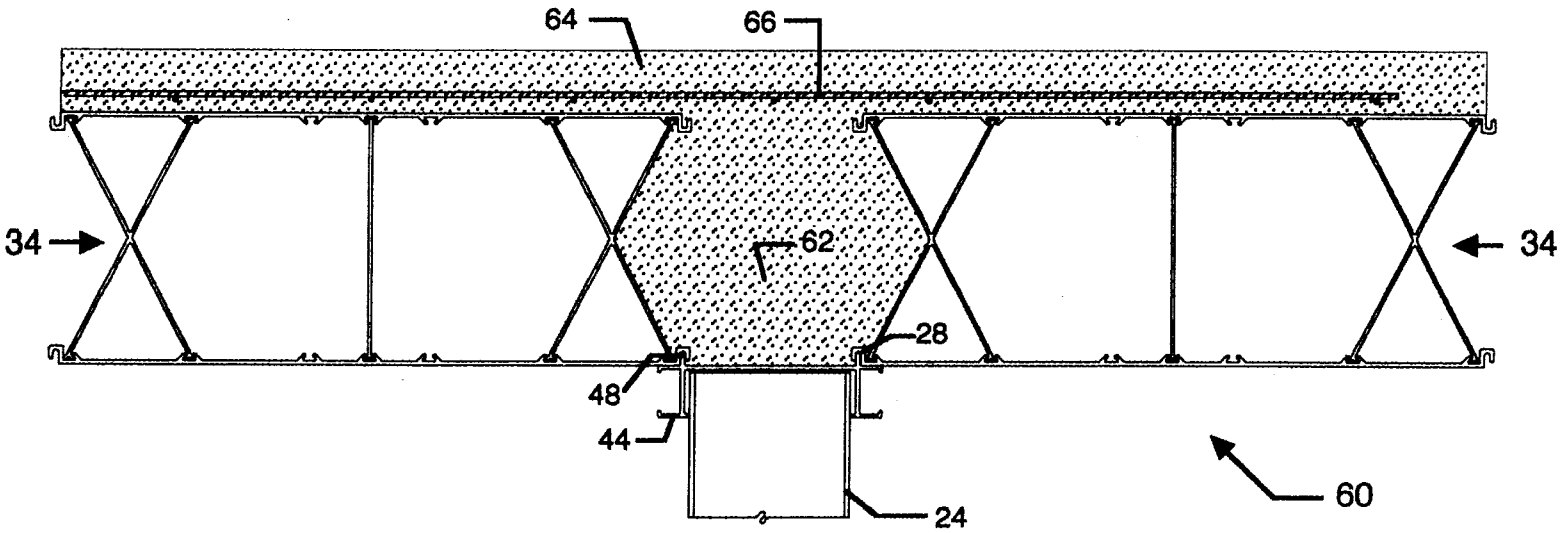
FIG. 9 is a cross sectional view of a floor and wall section in accordance with the invention.

To appreciate the implementation of wall panels 24 and floor panels 34 in a structural environment, reference should be made to FIG. 9. As illustrated here, a wall and floor section is designated generally by the numeral 60. Here, a wall panel 24 having an aligning wall cap 44 at the top thereof receives a pair of floor panels 34. During the concrete filling operation, a concrete header 62 is formed in the area between the floor panels 34 and above the wall panel 24. Similarly, at that time a concrete slab 64 is poured over a reinforcing wire mesh 66 as shown.

Figure 10:
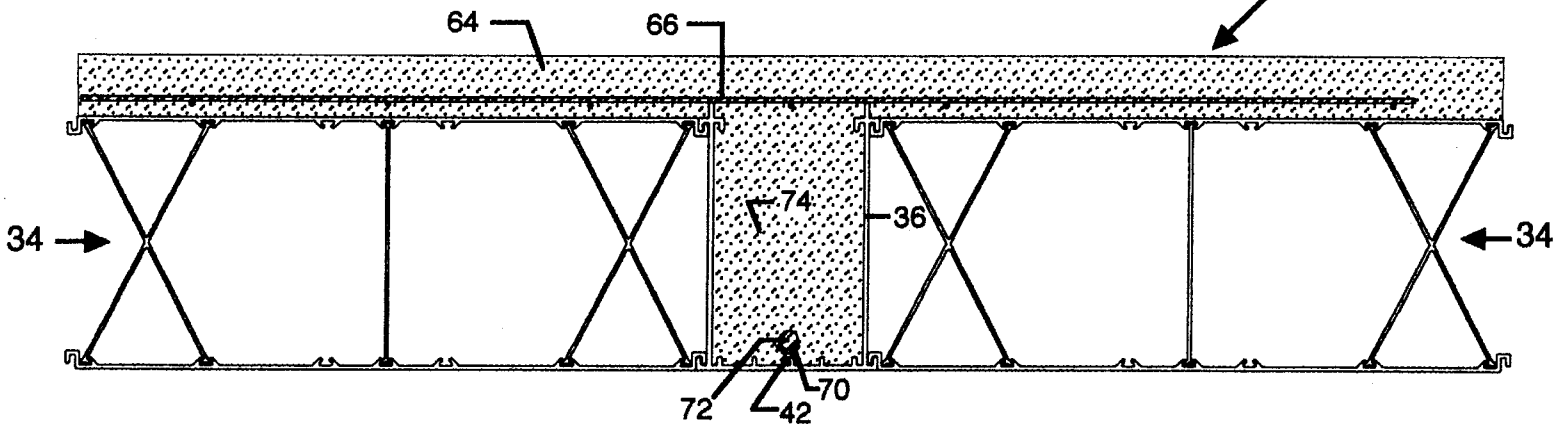
FIG. 10 is cross sectional view of a floor and purlin section according to the invention.

With reference now to FIG. 10, it can be seen that a floor section at a purlin made in accordance with the invention is designated generally by the numeral 68. Again, a plurality of floor panels 34 are interconnected with a common purlin form 36 by interengagement with appropriate connector channels 28. A rebar trough 70 is interconnected with the rebar clip 42 and receives a piece of rebar 72 for purposes of providing structural integrity and interconnection of the concrete 74 with adjoining purlin members. Those skilled in the art will appreciate that the rebar trough 70 may be configured to extend to any desired height above the rebar clip 42 such that the rebar 72 is positioned to provide the most structural integrity.

Figure 11:
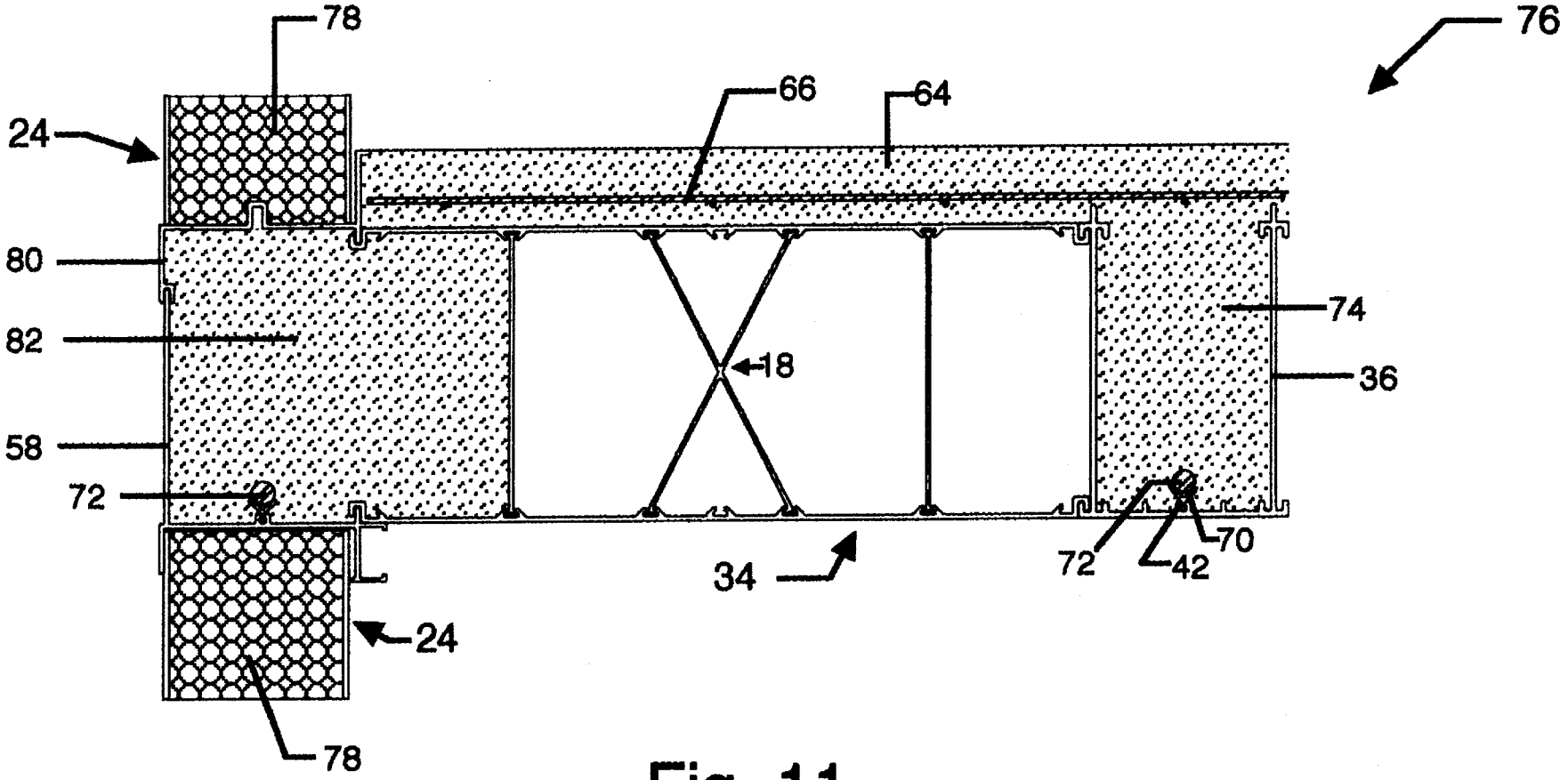
FIG. 11 is a cross sectional view of a floor and insulated curtain wall section made in accordance with the invention.

FIG. 11 presents a floor section at an exterior insulated curtain wall and designates the same by the numeral 76. Here, insulation 78 such as foam or the like is provided in the wall panels 24. The lower wall panel 24 receives an aligning wall cap 58 which matingly engages with an aligning wall cap 80 for the top wall panel 24. As illustrated, the aligning wall cap 80 provides for retaining and establishing the height of a concrete floor slab 64 having a reinforcing mesh 66 therein. Also as shown, a concrete header 82 is defined between the aligning wall caps 58, 80 and the spacer 18. Rebar 72 may also be provided for customary purposes.

Figure 12:
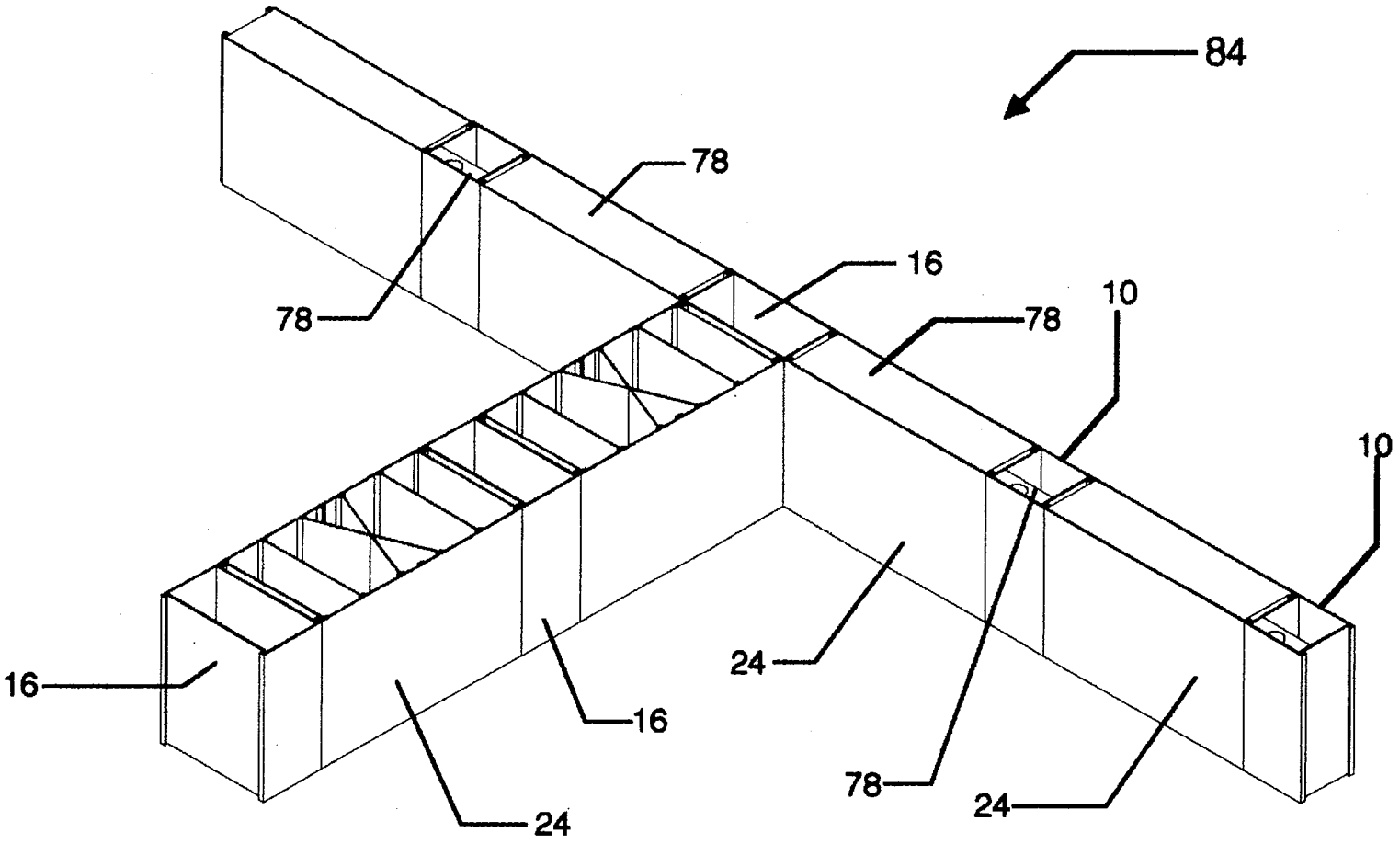
FIG. 12 is an illustrative perspective view of the intersection of a structural wall and exterior curtain wall according to the invention.

With an appreciation of the basic structural elements and features of the invention, the actual construction technique of a building in accordance with the invention may now be appreciated with reference to the remaining drawings. As shown in FIG. 12, structural walls and exterior curtain walls may be formed by the appropriate interconnection of wall panels 24 and column connectors 10, 16. Appropriate insulation 78 fills certain desired ones of the panels 24. Additionally, and where desired, partial insulation panels may be inserted into certain of the support columns 10 as desired. The resultant intersection of the structural wall and exterior curtain wall is designated generally by the numeral 84 in FIG. 12.

Figure 13:
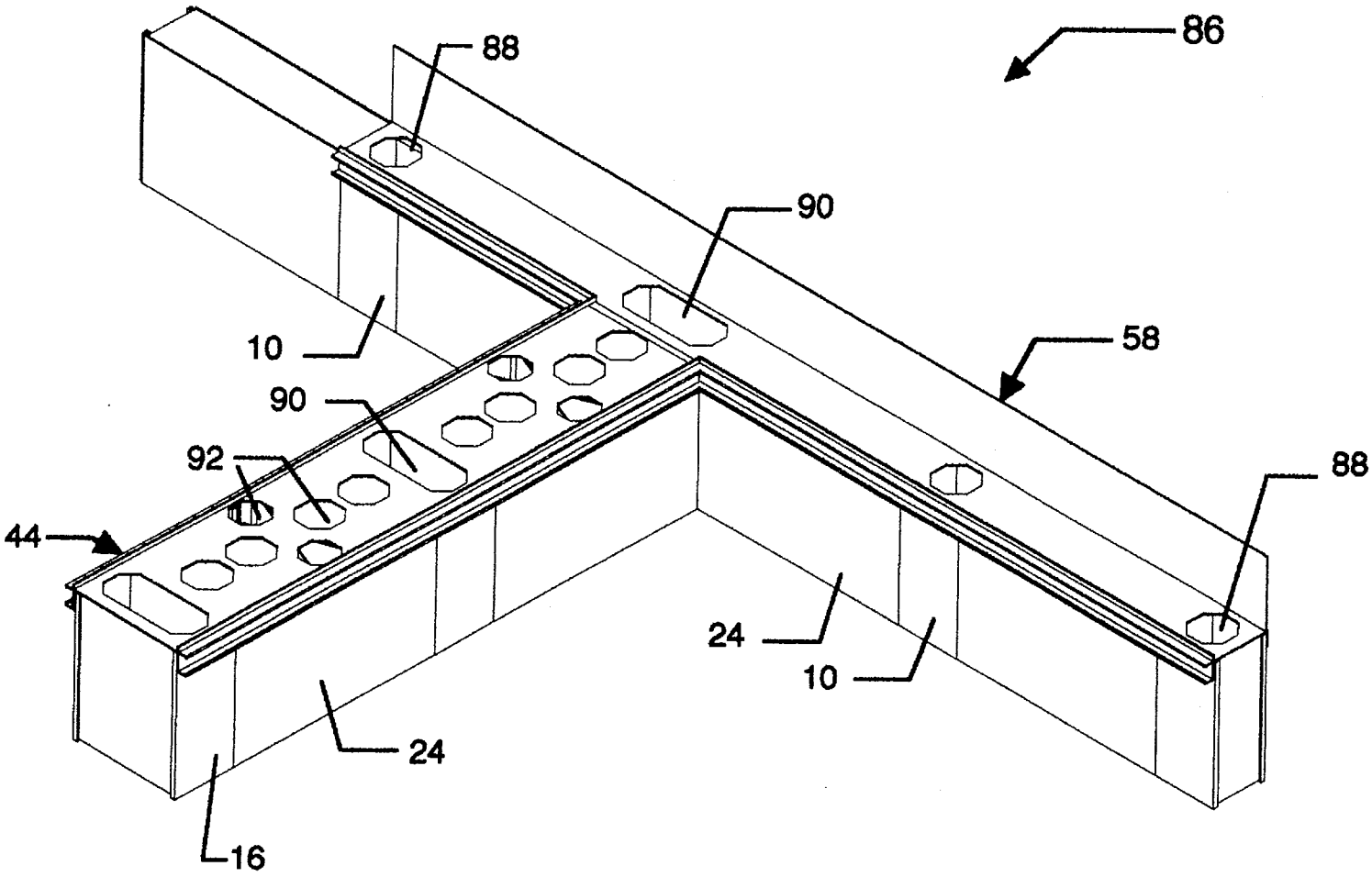
FIG. 13 is an illustrative view of the structure of FIG. 12 with the wall caps installed.

With reference now to FIG. 13, it can be seen that the structure of FIG. 12 has been modified by The addition of aligning wall caps 44, 58 as shown. The resultant structure, designated by the numeral 86, demonstrates an adaptability to receive floor panels and the like as will be discussed below. It will here be appreciated that openings 88 are provided in the wall caps 58 to communicate with the column connectors 10, while openings 90 are provided in the wall caps 44, 58 to communicate with the column connector 16. Additionally, openings 92 are provided in the wall caps 44 to communicate with the interior of the wall panels 24. It will be appreciated that the openings 88, 90, 92 are provided to allow for passage of rebar, concrete, and the like from one wall area to the next vertically adjacent wall area.

Figure 14:
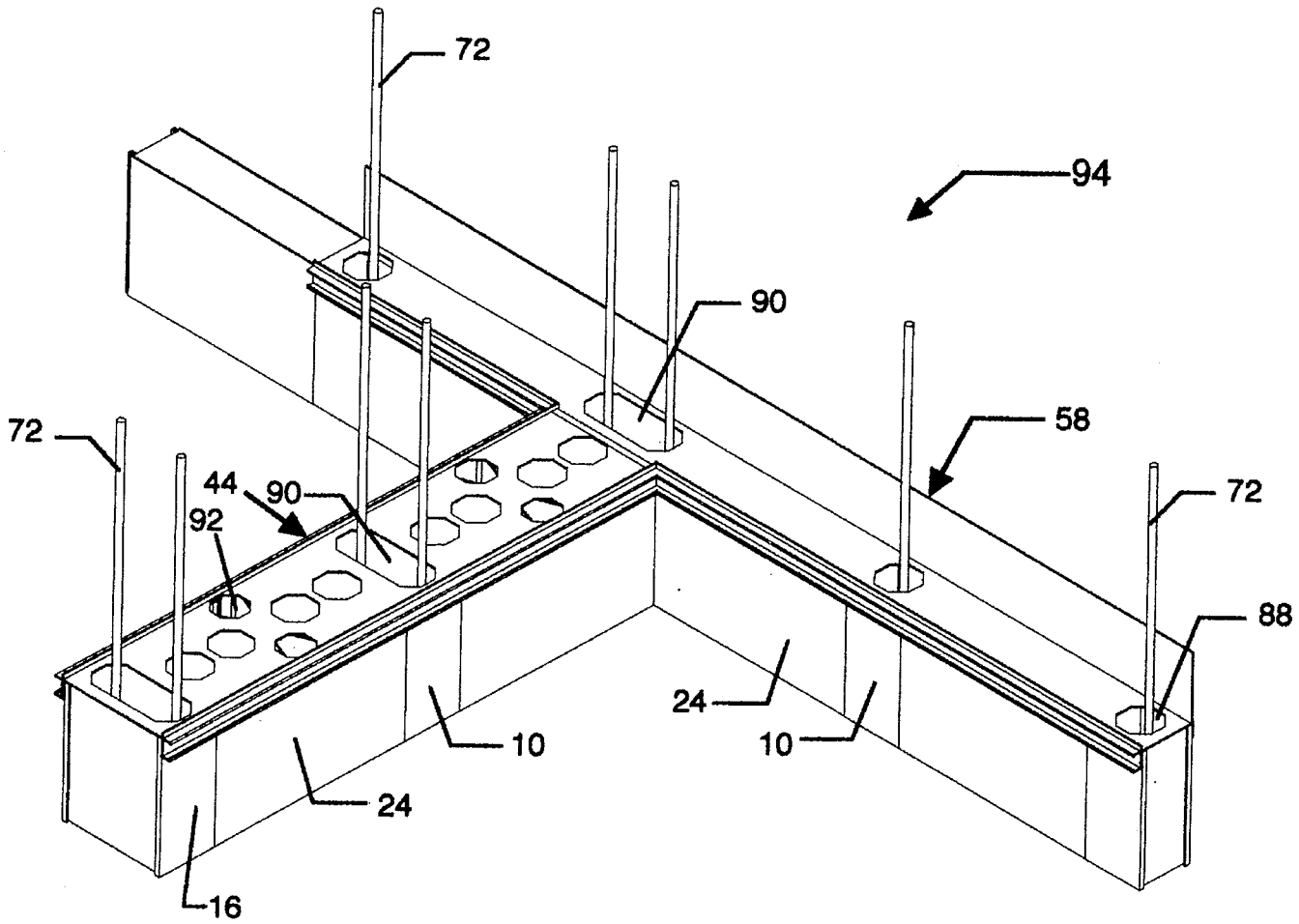
FIG. 14 is an illustrative view of the structure of FIG. 13 with rebar installed.

As illustrated in FIG. 14 by the numeral 94, the structure of claim 13 is shown with the rebar 72 in place, the same extending from the column connectors 10, 16 through the associated openings 88, 90 in the sill caps 44, 58.

Figure 15:
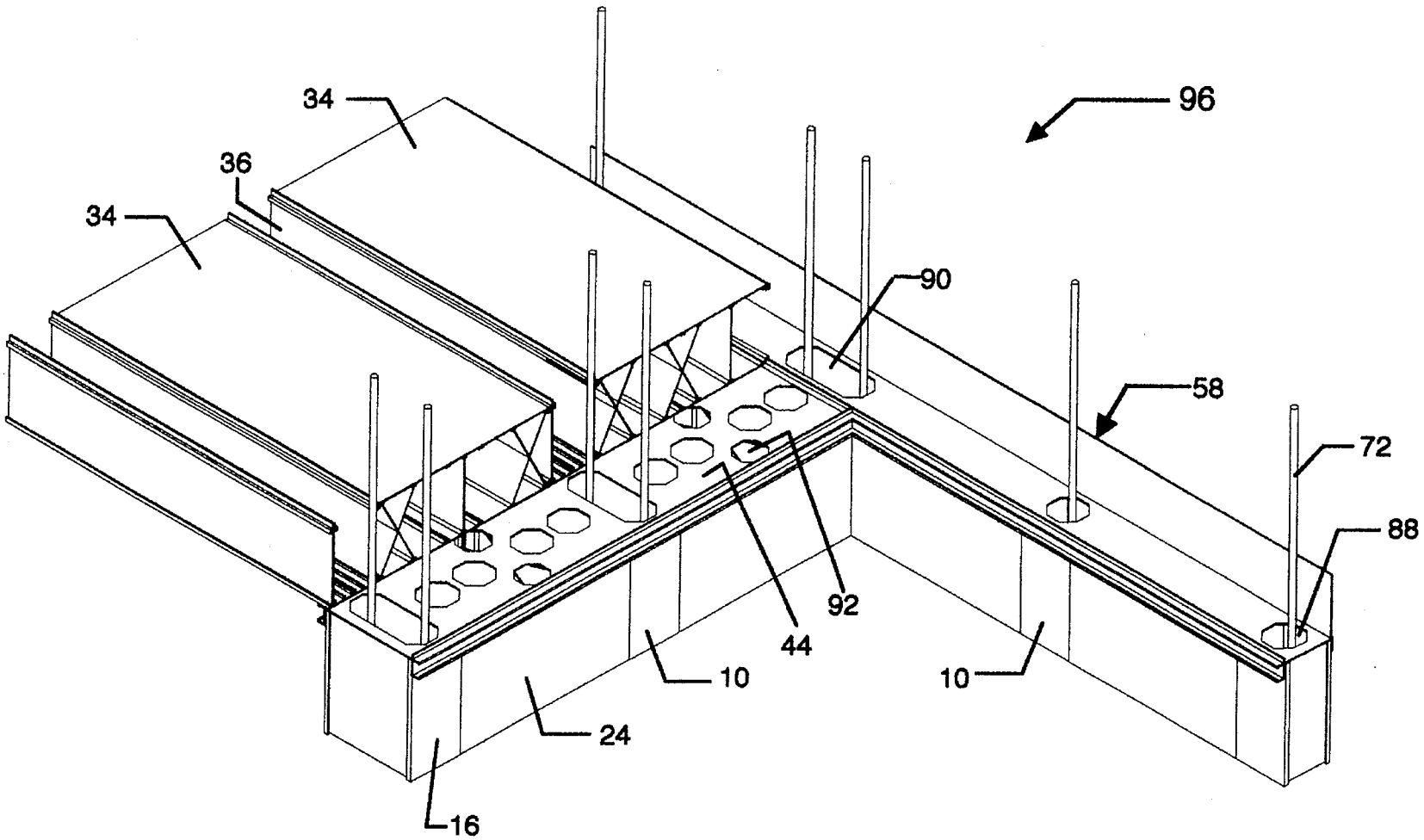
FIG. 15 is an illustrative view of the structure of FIG. 14 with certain floor forms installed.
Figure 16:
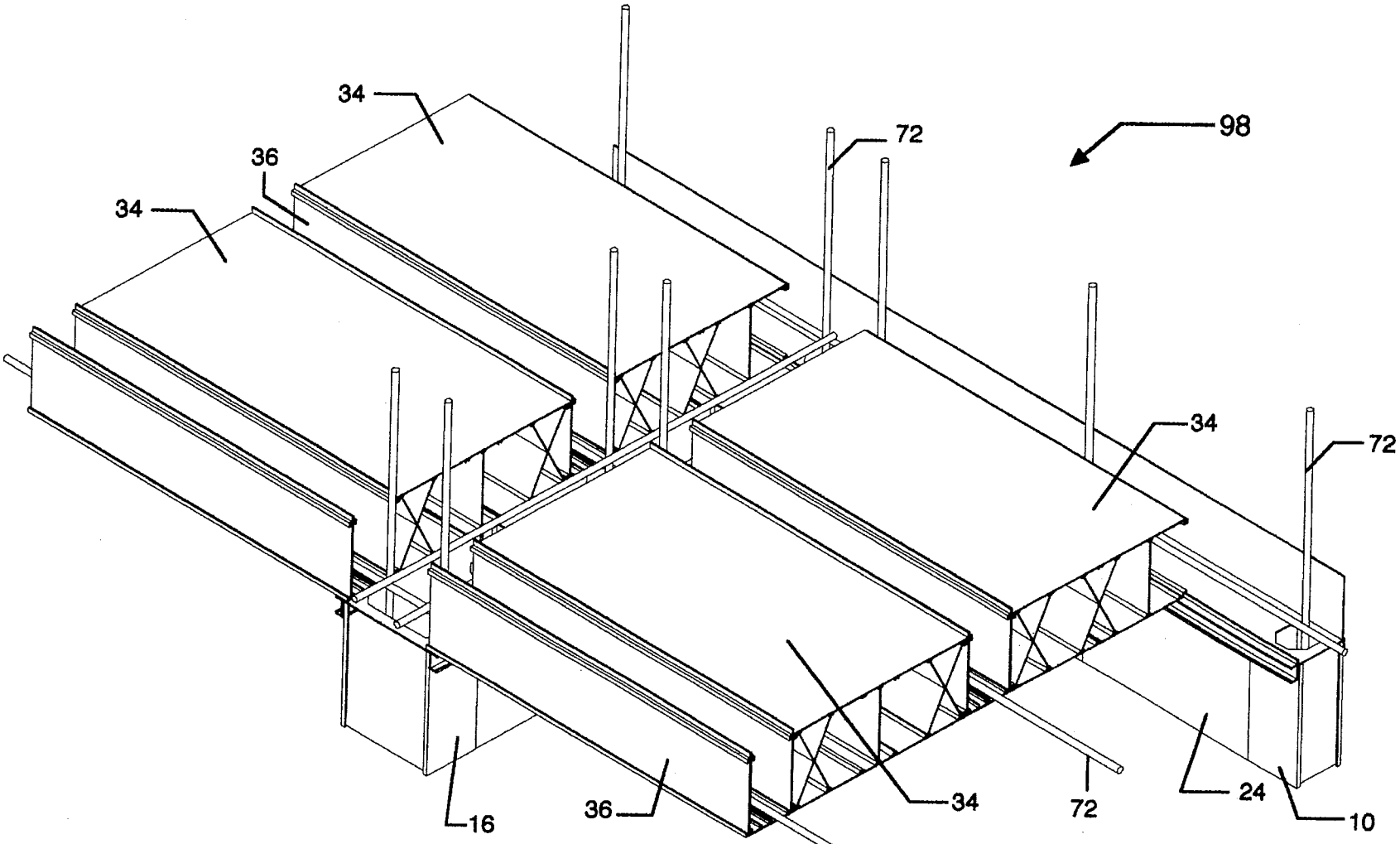
FIG. 16 is an illustrative view of the structure of FIG. 15 with additional floor forms installed.

In FIG. 15, and designated by the numeral 96, the structure 94 of FIG. 14 is shown as being modified by the attachment of floor panel forms 34 with a purlin form 36 interconnecting the same. As illustrated, the floor panel forms 34 interconnect at the side edge portions of the wall caps 44, 58. Additional floor panels 34 and purlin forms 36 are applied to the structure which is now designated by the numeral 98 in FIG. 16. Here, rebar 72 is also shown as extending through the purlin forms and along the wall caps for purposes of providing structural integrity and interconnection between the various structural elements.

The number 100 serves to designate the structure 98 with an additional aligning wall cap 80 applied to the assembly thereof and interconnecting with the wall cap 58 and floor panels 34. As illustrated, rebar 72 further extends through the openings 88, 90 to further provide for interconnection of the resultant concrete columns and headers when concrete is introduced into the various passages and cavities defined by the structure 100.

Figure 17:
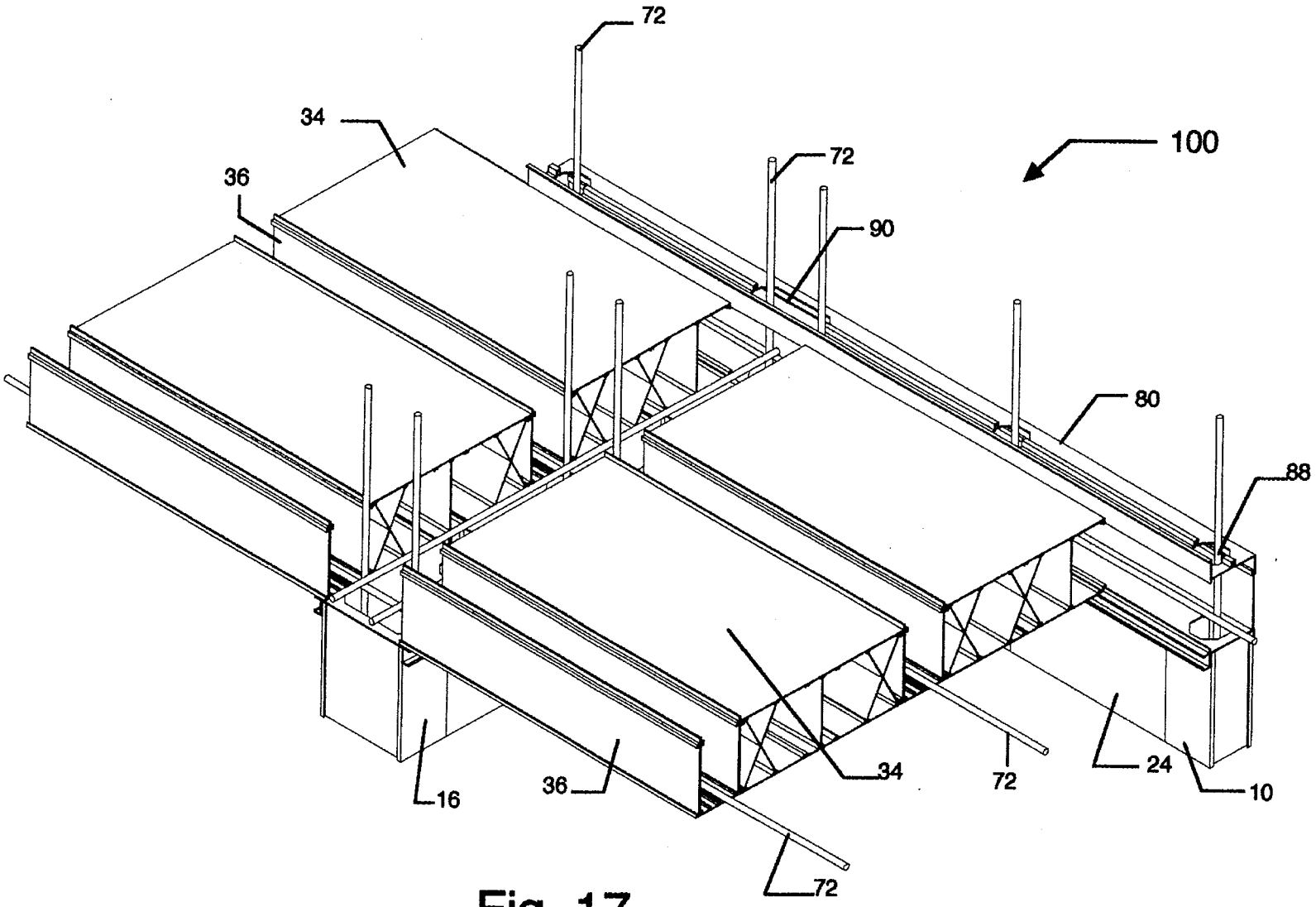
FIG. 17 is an illustrative view of the structure of FIG. 16 with aligning sill caps installed.
Figure 18:
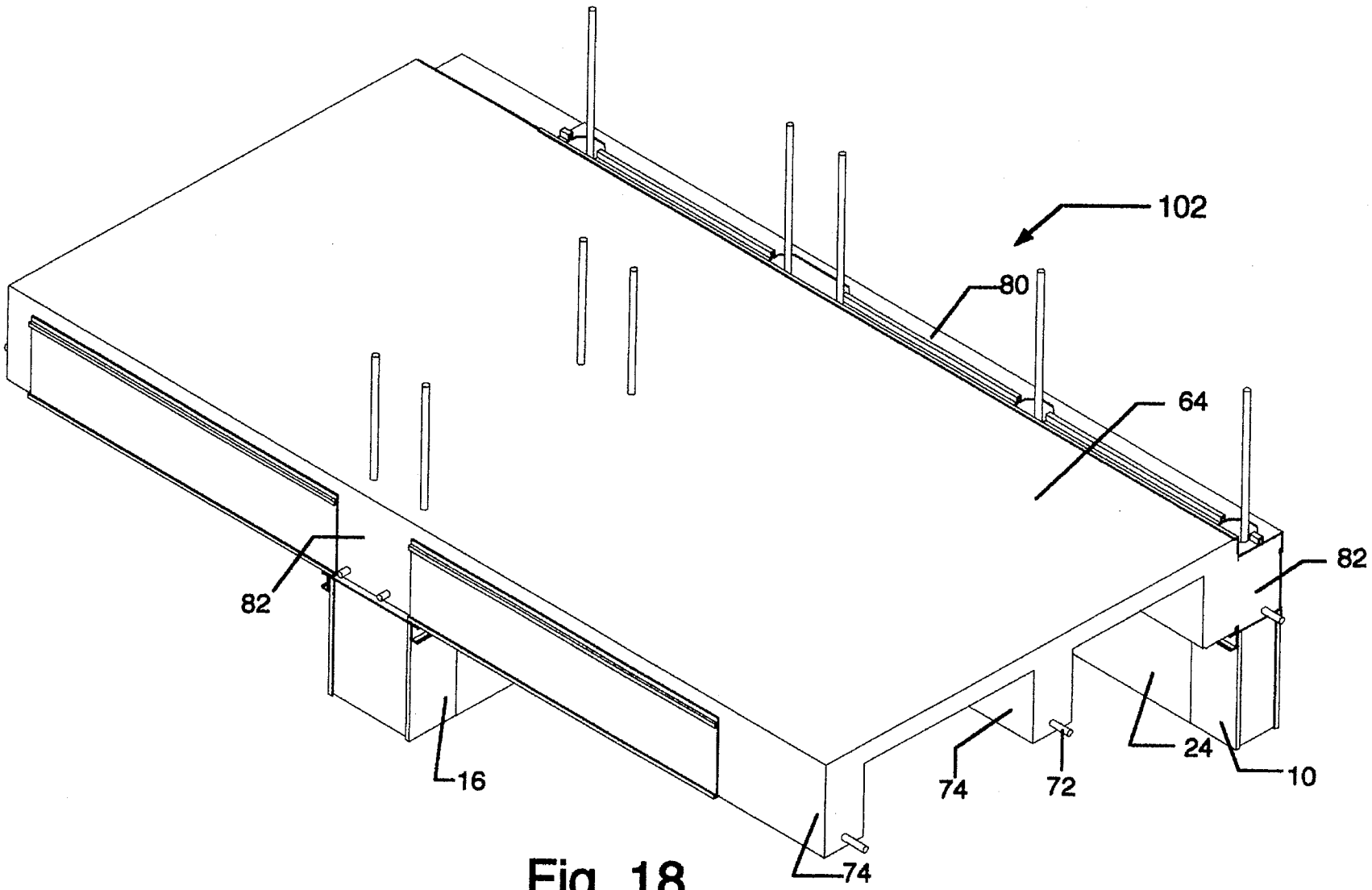
FIG. 18 is an illustrative view of the structure of FIG. 17 with concrete installed within the forms.

Those skilled in the art will appreciate that with the various wall panels 24, floor panels 34, purlins 36, aligning sill and wall caps 44, 58, 80, rebar 72, and the like all in place as illustrated in FIG. 17, concrete may be introduced into selected areas in a continuous pour operation to effectuate the resultant structure illustratively shown in FIG. 18 and designated by the numeral 102. Here, concrete purlins 74 with reinforcing rebar 72 are supported by headers 82 supported over the columns 10, 16. The skins of certain of the various panels are removed in the illustration of FIG. 18 for purposes of illustrating the presence of the concrete structural features. However, it will appreciated that the panel skins will typically remain in place and provide the finished surface for the resultant structure, obviating the need for actually "finishing" the concrete surfaces. In the preferred embodiment, the top surface of the slab 64 is exposed and, accordingly, is necessarily finished during the erecting process.

Figure 19:
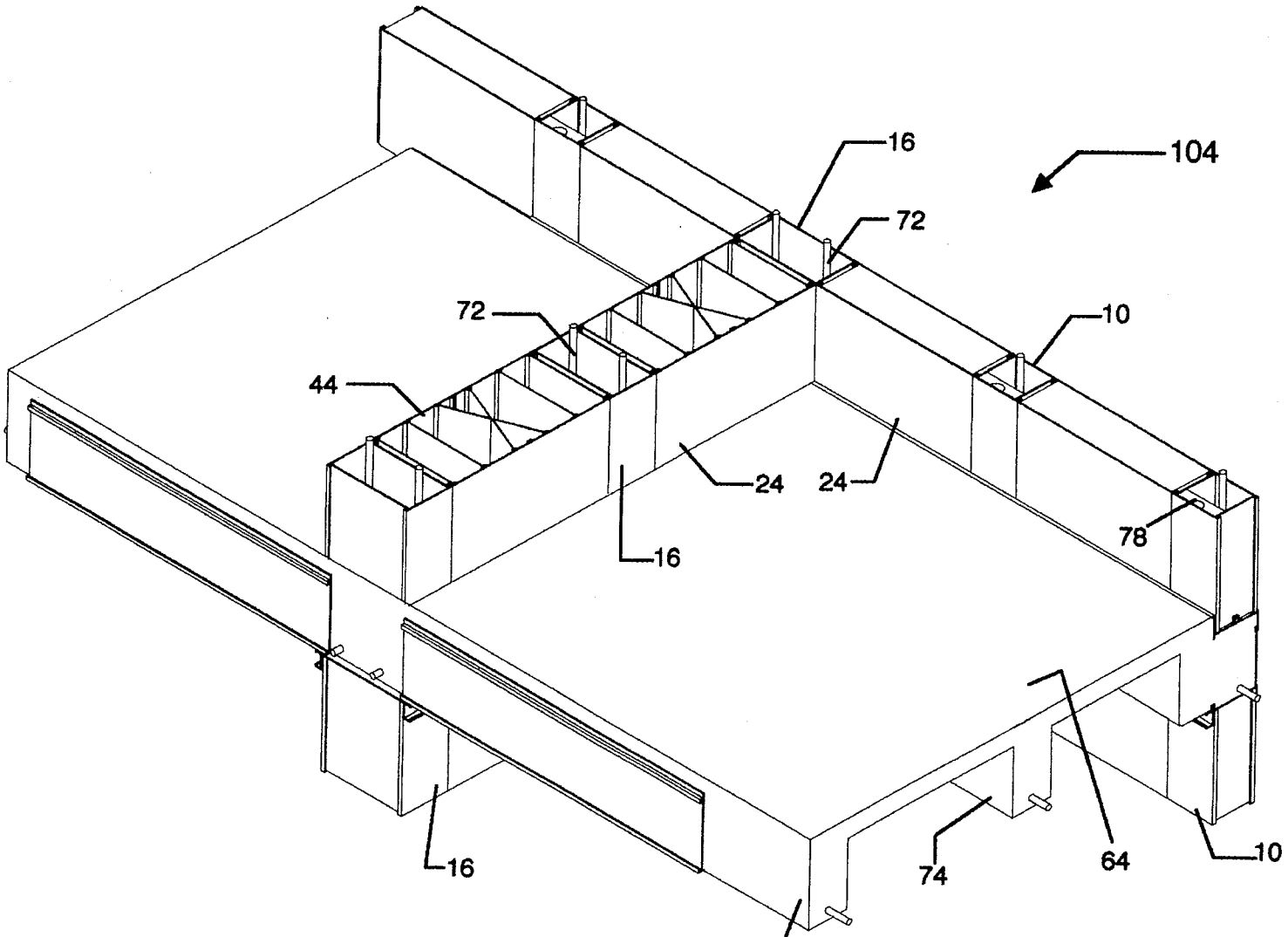
FIG. 19 is an illustrative view of the structure of FIG. 18 showing the upper wall form in place.

As illustrated in FIG. 19 by the numeral 104, additional wall panels 24 and connector columns 10, 16 are provided in interconnection with the wall caps and the like of the lower wall and floor assemblies as shown. It will be appreciated that the extension of the rebar 72 and the column connectors 10, 16 provides for structural continuity of the column connectors from one floor to the next, assuring for an integral structure from floor-to-floor and wall-to-wall.

Figure 20:
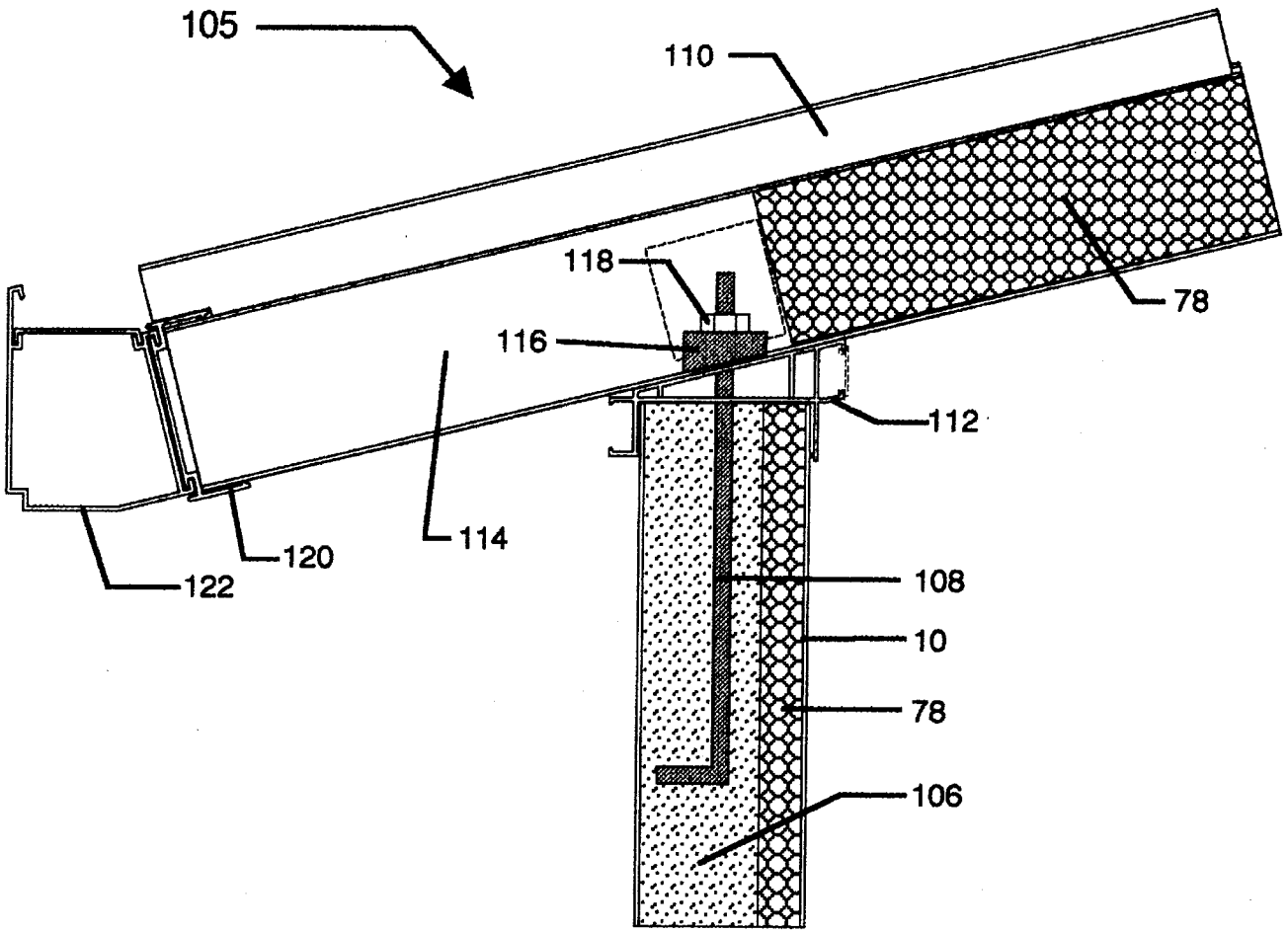
FIG. 20 is a cross sectional view of an intersection of a roof and ceiling panel with a wall column connector in accordance with the invention.

With attention now to FIG. 20, it will be appreciated that any building structure must be capped by a roof or other appropriate top surface to protect the same from the elements. As shown in FIG. 20, and designated by the numeral 105, there is presented the interconnection of an appropriate roof system with a wall structure. Here, a column connector 70 has an inner panel of insulation foam 78 and an outer structural element of poured concrete 106. A threaded connector 108 is secured in the concrete 106 and extends therefrom through an appropriate sloping wall cap 112, the same being of triangular cross section and providing the slope angle for the roof assembly. The roof assembly comprises a roof panel 110 connected to a ceiling panel 114, the latter having appropriate insulation 78 therein above the occupied space of the resultant building. It will be appreciated that the roof panel 110 and the ceiling panel 114 are constructed in a fashion similar to the wall panels and floor panels discussed above, having strengthening and reinforcing spacers as also earlier discussed. The ceiling panel 114 is secured to the sloping wall cap 112 by means of a nut 118 threadedly secured to the threaded anchor 108. A beveled washer 116, having a sloping surface corresponding to that of the sloping wall cap 112, is interposed between the nut 118 and an interior surface of a skin of the ceiling panel 114, as shown. To complete the structure of the ceiling and roof panels assembly 105, an appropriate endcap 120 is provided over the end of the ceiling panel 114 and adapted to securingly receive a gutter assembly 122.

It should now be appreciated by those skilled in the art that the instant invention provides an apparatus and technique for assembling a building structure in situ by the placement of a plurality of interconnected floor, wall, ceiling, and roof panels and subsequently filling selected portions of such panels with concrete and/or insulation. The panels themselves are typically formed by interconnected skins with spacers, such skins having exposed exterior surfaces which serve as the finished surfaces of the resultant structure. For example, the skins of the wall panels serve as the wall surfaces themselves, while the exposed lower skins of the floor panels serve as the sealing surface of the room or area below. The exterior skin surface may serve as the exterior surfaces of the building itself, where such walls are exterior walls. In that regard, the skin surfaces may be textured or architecturally treated as desired.

Thus it can be seen that the objects of the invention have been satisfied by the structure presented above. While in accordance with the patent statutes only the best mode and preferred embodiment of the invention have been presented and described in detail, it is to be understood that the invention is not limited thereto or thereby. Accordingly, for a appreciation of the true scope and breadth of the invention, reference should be made to the following claims.

What is claimed is:

1. A building structure, comprising:

a first plurality of wall panels;

a second plurality of column connectors interposed between and among selected ones of said wall panels and interconnecting said selected ones of said wall panels;

a third plurality of wall caps extending over top surfaces of said wall panels and column connectors, said plurality of wall caps having a side plate extending upwardly therefrom; and a fourth plurality of floor form assemblies received by and extending from said wall caps, wherein a top surface of said floor form assemblies receives concrete at a fixed thickness established by said side plate.

2. The building structure according to claim 1, wherein each said wall panel comprises a pair of spaced apart skins interconnected by spacers extending longitudinally therebetween, said spacers defining longitudinal cavities between said skins.

3. The building structure according to claim 2, wherein said skins comprise finished wall surfaces.

4. The building structure according to claim 2, wherein said spacers comprise planar sheets.

5. The building structure according to claim 4, wherein said spacers comprise pairs of said planar sheets intersecting each other intermediate said pair of skins.

6. The building structure according to claim 2, wherein said column connectors are elongated and of rectangular cross section, being defined by four interconnected side plates.

7. The building structure according to claim 6, wherein said column connectors further comprise channel members extending laterally along certain corners thereof in interconnection with connector channels along lateral ends of said wall panels.

8. The building structure according to claim 2, wherein certain of said wall caps have apertures therein, certain of said apertures communicating with an inner cavity of an associated column connector and others of said apertures communicating with said cavities defined by said spacers.

9. The building structure according to claim 8, wherein said apertures of said wall caps receive concrete therethrough for deposit in said cavities between said spacers and panel skins and within said column connectors.

10. The building structure according to claim 9, wherein rebar extends between aligned column connectors through said apertures associated therewith.

11. The building structure according to claim 2, wherein said floor form assemblies comprise a pair of spaced apart skins interconnected with longitudinally extending panel spacers.

12. The building structure according to claim 11, wherein said floor form assemblies further comprise longitudinally extending header forms in alignment with supporting wall panels, said header forms defined by certain of said panel spacers.

13. The building structure according to claim 12, wherein said floor form assemblies further comprise longitudinally extending purlin forms.

14. The building structure according to claim 13, wherein said purlin forms further comprise rebar troughs extending along and elevated above a bottom plate of said purlin form, said rebar troughs receiving and maintaining rebar in a purlin formed by said purlin form, said rebar extending from a purlin of one floor form assembly to another.

15. The building structure according to claim 13, wherein said concrete of said top surface extends to said header and purlin forms, forming headers and purlins.

16. The building structure according to claim 13, further comprising a wire mesh reinforcement extending through said concrete of said top surface.

17. The building structure according to claim 2, wherein said spacers have tear drop shaped slots therein for receiving and supporting rebar passing therethrough.

18. The building structure according to claim 2, further comprising a roof panel anchored to a wall panel, said roof panel having an insulated inner section and having a gutter connected to an exterior peripheral edge; and a sloping wall cap interposed between said roof panel and said wall panels to provide the desired slope angle for the roof assembly.

19. A method for erecting a building, comprising:

(a) interconnecting a plurality of wall panels to each other through a plurality of column connectors;

(b) placing wall caps upon top surface portions of said interconnected wall panels and column connectors, said wall caps having a side plate extending upwardly therefrom;

(c) connecting floor panel forms to said wall caps, said floor panel forms having cavities for forming headers over supporting wall panels and purlins between said supporting wall panels;

(d) filling selected ones of said wall panels with concrete, filling said purlin and header cavities with said concrete, and covering a top surface of said floor panel forms to a predetermined level established by said side plates with concrete, thereby defining a first story of the building; and (e) repeating steps (a–d) to define each desired subsequent floor.

* * * * *